US010821310B2

(12) United States Patent
Jacob

(10) Patent No.: US 10,821,310 B2
(45) Date of Patent: Nov. 3, 2020

(54) HARNESS WITH PIVOTING HIP CONNECTION

(71) Applicant: MSA Technology, LLC, Cranberry Township, PA (US)

(72) Inventor: Matthew Frederick Jacob, Pittsburgh, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 99 days.

(21) Appl. No.: 15/698,385

(22) Filed: Sep. 7, 2017

(65) Prior Publication Data

US 2019/0070442 A1 Mar. 7, 2019

(51) Int. Cl.
*A62B 35/00* (2006.01)

(52) U.S. Cl.
CPC ..... *A62B 35/0018* (2013.01); *A62B 35/0025* (2013.01); *A62B 35/0031* (2013.01)

(58) Field of Classification Search
CPC ..... Y10T 24/3651; Y10T 24/3653; Y10T 24/3683; Y10T 24/3685
See application file for complete search history.

(56) References Cited

U.S. PATENT DOCUMENTS 1,682,771 A * 9/1928 Butler ..... A44B 1/30 24/105
2,901,796 A * 9/1959 Hope ..... A44B 1/34 24/108
3,022,855 A 2/1962 Lewis
3,389,439 A * 6/1968 Papazian ..... A44B 1/28 24/114.05
5,433,289 A 7/1995 O'Rourke
6,233,782 B1 * 5/2001 Regele ..... F16L 5/10 16/2.1
6,311,884 B1 * 11/2001 Johnson ..... A45F 3/04 224/153
6,374,455 B1 * 4/2002 Regele ..... F16L 5/10 16/2.1
7,441,997 B2 * 10/2008 Ramasamy ..... B23K 9/207 411/171
9,492,692 B2 * 11/2016 Myers ..... A62B 35/00
2006/0102423 A1 * 5/2006 Lang ..... A62B 35/0012 182/36

(Continued)

FOREIGN PATENT DOCUMENTS

JP 2009261537 A * 11/2009 ..... A62B 35/0025

OTHER PUBLICATIONS

JP2009261537A_Description_202003040907—machine translation of JP-2009261537-A.*

*Primary Examiner* — Marcus Menezes
(74) *Attorney, Agent, or Firm* — The Webb Law Firm

(57) ABSTRACT

A wearable harness has a first strap overlapping a second strap, with each of the first strap and the second strap having a longitudinal axis extending in a direction of a major longitudinal length. The wearable harness further has a reinforced opening extending through each of the first strap and the second strap. The reinforced openings have a pivot axis extending in a direction substantially perpendicular to the longitudinal axis of each of the first strap and the second strap when the reinforced openings overlap each other. The first strap and the second strap are pivotally movable relative to one another about the pivot axis of the central openings.

15 Claims, 5 Drawing Sheets

(56) References Cited

U.S. PATENT DOCUMENTS

| | | | | |
|---|---|---|---|---|
| 2008/0035423 | A1* | 2/2008 | Meillet | A62B 35/0056 182/3 |
| 2009/0255756 | A1* | 10/2009 | Green | A62B 35/0025 182/3 |
| 2011/0174572 | A1* | 7/2011 | Myers | A62B 35/00 182/3 |
| 2012/0205478 | A1* | 8/2012 | Balquist | A62B 35/04 242/379.1 |
| 2014/0001334 | A1* | 1/2014 | Hirst | A62B 35/04 248/560 |
| 2014/0124292 | A1* | 5/2014 | Montgomery | A62B 35/0093 182/3 |
| 2015/0041512 | A1* | 2/2015 | Rief | H01M 2/1005 224/633 |
| 2016/0324301 | A1* | 11/2016 | Babb | A45F 5/021 |
| 2017/0216635 | A1* | 8/2017 | Stibilj | A62B 35/0018 |
| 2019/0070442 | A1* | 3/2019 | Jacob | A62B 35/0018 |

* cited by examiner

HARNESS WITH PIVOTING HIP CONNECTION

BACKGROUND OF THE INVENTION

Field of the Invention

The present invention relates generally to a fall protection harness and, in particular, to a fall protection harness having a pivoting strap connection arrangement between at least two straps.

Description of the Related Art

As is known in the art, there exist various safety devices and arrangements that can be worn by or attached to a user to ensure the wearer's safety in certain situations. Such mechanisms come in many forms, including, but not limited to, harnesses and safety belts. Full body harnesses are widely used for lifting and lowering individuals in dangerous situations and as a primary component in a personal fall arrest system. These harnesses can also be used for work positioning, travel restriction, ladder climbing, rescue retrieval, and evacuation. While these harnesses are used mainly in an industrial setting, and particularly the construction industry where the likelihood and danger of falls from heights is both numerous and significant, a full body harness can be used in various other applications in which total suspension and support of the body must be ensured, either expectedly or unexpectedly.

While there are many variations in full body harness construction, all typically include a plurality of elongate straps that are combined together to fit around a user's body. In some embodiments or aspects, a full body harness may have an attachment point (D-ring) typically positioned in a central portion of the user's back, and a plurality of straps routed around predetermined portions of the user's body in such a manner as to hold or suspend the user in the event of a fall.

With reference to FIG. 1, a harness 200 is shown in accordance with a prior art embodiment. The harness 200 has a pair of leg straps 202*a*, 202*b* configured to attach around a user's legs below a user's groin area. When attached, the leg straps 202*a*, 202*b* loop around or encircle each of the user's legs. The harness 200 further has a first shoulder strap 204*a* and a second shoulder strap 204*b* configured to extend over at least a portion of the user's shoulders. The first and second shoulder straps 204*a*, 204*b* are arranged to overlap one another in an X-shaped configuration across the user's back. When the harness 200 is worn by the user, a chest strap 206 releasably connects the first and second shoulder straps 204*a*, 204*b* across the user's chest, while a back strap 208 connects the first and second shoulder straps 204*a*, 204*b* across the user's back. Each leg strap 202*a*, 202*b* is connected to the first shoulder strap 204*a* at its first end 210*a* and to the second shoulder strap 204*b* at its second end 210*b* such that the first and second ends 210*a*, 210*b* of each leg strap 202*a*, 202*b* overlap each other at a hip connection 212. In some embodiments or aspects, such as shown in FIG. 2A, the hip connection 212 may be a fixed connection, wherein the first end 210*a* of each leg strap 202*a*, 202*b* overlaps the second end 210*b* at a sewn joint 214. While simple and inexpensive to make, the sewn joint 214 does not allow for relative movement of the first and second ends 210*a*, 210*b*, thereby making the harness 200 uncomfortable to wear and limiting the user's range of motion while wearing the harness 200. In some examples, the harness 200 can bend or fold at the hip connection 212 when the user is crouching while wearing the harness 200. This presents a safety risk to the user because the bent or folded portion of the harness 200 at the hip connection 212 can become caught on a nearby object and unbalance the user.

With reference to FIG. 2B, a buckle 216 may be provided at the hip connection 212 for connecting the first and second ends 210*a*, 210*b* of each leg strap 202*a*, 202*b* with the first and second shoulder straps 204*a*, 204*b*. While the buckle 216 allows for relative movement of the straps, the buckle 216 increases the overall cost, complexity, and weight of the harness 200. The hip connection 212 is configured to allow relative movement of the first and second ends 210*a*, 210*b* of each leg strap 202*a*, 202*b*.

With reference to FIG. 2C, the hip connection 212 may be configured as a slot 218 in one of the first end 210*a* and the second end 210*b* of each leg strap 202*a*, 202*b* such that the other of the first end 210*a* and the second end 210*b* is received through the slot 218. Two stitches 220*a*, 220*b* are provided on at least one of the first end 210*a* and the second end 210*b* of each leg strap 202*a*, 202*b* to attach a secondary strap 222, such as an extended portion of one shoulder strap 204*a*. The slot 218 allows the first end 210*a* and the second end 210*b* of each leg strap 202*a*, 202*b* to move relative to one other at the hip connection 212. While the slot 218 allows for relative movement of the straps, the slot 218 increases the manufacturing complexity and cost of the harness 200.

Accordingly, there is a need in the art for an improved harness that addresses certain drawbacks and deficiencies associated with known harnesses. For example, there is a need for an improved harness with an improved connection between intersecting straps of the harness, such as intersecting portions of the leg straps. There is a further need in the art for an improved harness that can be easily and effectively worn by the user in a variety of work environments without compromising the user's ability to move and without adding additional weight that must be borne by the user. There is also a need for an improved harness with increased safety compliance at the worksite, and with increased comfort and unobstructed range of motion.

SUMMARY OF THE INVENTION

Generally, provided is an improved fall protection harness having a pivoting strap connection arrangement between at least two straps. Preferably, provided is an improved harness having a pivoting strap connection arrangement between two intersecting shoulder straps. Preferably, provided is an improved harness that can be easily and effectively worn by the user in a variety of work environments without compromising the user's ability to move and without adding significant weight that must be borne by the user. Preferably, provided is an improved harness that not only leads to increased safety compliance at the worksite, but also provides increased comfort and unobstructed range of motion to the user.

In some preferred and non-limiting embodiments or aspects, provided is a wearable harness that may have a first strap overlapping a second strap, each of the first strap and the second strap having a longitudinal axis extending in a direction of a major longitudinal length. The harness may further have a reinforced opening extending through each of the first strap and the second strap. The reinforced openings may have a pivot axis extending in a direction substantially perpendicular to the longitudinal axis of each of the first strap and the second strap when the reinforced openings overlap each other. The first strap and the second strap may be pivotally movable relative to one another about the pivot axis.

In other preferred and non-limiting embodiments or aspects, the first strap may be at least a portion of a first shoulder strap and the second strap may be at least a portion of a second shoulder strap. At least one of the reinforced openings may be a central opening of a grommet having a first grommet on the first strap and a second grommet on the second strap. The first grommet may be identical to or different from the second grommet. One of the first grommet and the second grommet may have a protrusion and the other of the first grommet and the second grommet may have a recess configured for removably or non-removably receiving the protrusion. At least one of the reinforced openings may be a central opening of a grommet extending in a direction substantially perpendicular to the longitudinal axis of the first strap and the second strap. A connecting element may be received within each reinforced opening. The connecting element may have a first portion removably connected to a second portion. The first portion and the second portion of the connecting element may be connected to one another by a threaded connection, an interference fit, snap fit, an adhesive, a spin welded connection, a sonic welded connection, a riveted connection, or a combination thereof. The connecting element may be configured to break when exposed to a predetermined force. The predetermined force may be a shear force directed in a direction substantially perpendicular to the longitudinal axis of the connecting element. The predetermined force may be about 75 lbs. to about 2250 lbs. The connecting element may have a weakened portion configured to initiate a breaking of the connecting element when the connecting element is exposed to the predetermined force.

In other preferred and non-limiting embodiments or aspects, a wearable harness may have at least two overlapping straps, each of the at least two overlapping straps having a longitudinal axis extending in a direction of a major longitudinal length. The harness may further have a pivoting strap connection arrangement connected to the at least two overlapping straps. The pivoting strap connection arrangement may have a reinforced opening extending through each of the at least two overlapping straps. The reinforced openings have a pivot axis extending in a direction substantially perpendicular to the longitudinal axis of each of the at least two overlapping straps when the reinforced openings overlap each other. The pivoting strap connection arrangement may further have a connecting element received within the reinforced openings. The at least two overlapping straps are pivotally movable relative to one another about the pivot axis.

In other preferred and non-limiting embodiments or aspects, at least one of the reinforced openings may be a central opening of a grommet having a first grommet on a first of the at least two overlapping straps and a second grommet on a second of the at least two overlapping straps. One of the first grommet and the second grommet may have a protrusion and the other of the first grommet and the second grommet may have a recess configured for removably or non-removably receiving the protrusion. The connecting element may have a first portion removably connected to a second portion. The connecting element may be configured to break when exposed to a predetermined shear force directed in a direction substantially perpendicular to a longitudinal axis of the connecting element.

In other preferred and non-limiting embodiments or aspects, in a harness removably attachable to a body of a user and having at least two straps, a pivoting strap connection arrangement may be connected to the at least two straps, the pivoting strap connection arrangement having a pivot axis extending in a direction substantially perpendicular to a longitudinal axis of the at least two straps. The at least two straps may be pivotally movable relative to one another about the pivot axis.

Further preferred and non-limiting embodiments or aspects will now be set forth in the following numbered clauses.

Clause 1. A wearable harness comprising: a first strap overlapping a second strap, each of the first strap and the second strap having a longitudinal axis extending in a direction of a major longitudinal length; and a reinforced opening extending through each of the first strap and the second strap, wherein the reinforced openings have a pivot axis extending in a direction substantially perpendicular to the longitudinal axis of each of the first strap and the second strap when the reinforced openings overlap each other, and wherein the first strap and the second strap are pivotally movable relative to one another about the pivot axis.

Clause 2. The wearable harness of clause 1, wherein the first strap is at least a portion of a first shoulder strap and the second strap is at least a portion of a second shoulder strap.

Clause 3. The wearable harness of clause 1 or clause 2, wherein at least one of the reinforced openings is a grommet having a first grommet on the first strap and a second grommet on the second strap.

Clause 4. The wearable harness of any of clauses 1-3, wherein the first grommet is identical to the second grommet.

Clause 5. The wearable harness of any of clauses 1-4, wherein one of the first grommet and the second grommet has a protrusion and the other of the first grommet and the second grommet has a recess configured for removably or non-removably receiving the protrusion.

Clause 6. The wearable harness of any of clauses 1-5, further comprising a connecting element received within the central opening extending through each of the first grommet and the second grommet.

Clause 7. The wearable harness of any of clauses 1-6, wherein at least one of the reinforced openings is a central opening of a grommet extending in a direction substantially perpendicular to the longitudinal axis of the first strap and the second strap.

Clause 8. The wearable harness of any of clauses 1-7, further comprising a connecting element received within the central opening of the grommet.

Clause 9. The wearable harness of any of clauses 1-8, wherein the connecting element comprises a first portion removably connected to a second portion.

Clause 10. The wearable harness of any of clauses 1-9, wherein the first portion and the second portion of the connecting element are connected to one another by a threaded connection, an interference fit, snap fit, an adhesive, a spin welded connection, a sonic welded connection, a riveted connection, or a combination thereof.

Clause 11. The wearable harness of any of clauses 1-10, wherein the connecting element is configured to break when exposed to a predetermined force.

Clause 12. The wearable harness of any of clauses 1-11, wherein the predetermined force is a shear force directed in a direction substantially perpendicular to the longitudinal axis of the connecting element.

Clause 13. The wearable harness of any of clauses 1-12, wherein the predetermined force is about 75 lbs. to about 2250 lbs.

Clause 14. The wearable harness of any of clauses 1-13, wherein the connecting element has a weakened portion configured to initiate a breaking of the connecting element when the connecting element is exposed to the predetermined force.

Clause 15. A wearable harness comprising: at least two overlapping straps, each of the at least two overlapping straps having a longitudinal axis extending in a direction of a major longitudinal length; and a pivoting strap connection arrangement connected to the at least two overlapping straps, the pivoting strap connection arrangement comprising: a reinforced opening extending through each of the at least two overlapping straps, the reinforced openings extending in a direction substantially perpendicular to the longitudinal axis of each of the at least two overlapping straps when the reinforced openings overlap each other, and a connecting element received within each reinforced opening, wherein the at least two overlapping straps are pivotally movable relative to one another about the pivot axis.

Clause 16. The wearable harness of clause 15, wherein at least one of the reinforced openings is a central opening of a grommet having a first grommet on a first of the at least two overlapping straps and a second grommet on a second of the at least two overlapping straps.

Clause 17. The wearable harness of clause 15 or clause 16, wherein one of the first grommet and the second grommet has a protrusion and the other of the first grommet and the second grommet has a recess configured for removably or non-removably receiving the protrusion.

Clause 18. The wearable harness of any of clauses 15-17, wherein the connecting element comprises a first portion removably connected to a second portion.

Clause 19. The wearable harness of any of clauses 15-18, wherein the connecting element is configured to break when exposed to a predetermined shear force directed in a direction substantially perpendicular to a longitudinal axis of the connecting element.

Clause 20. In a harness removably attachable to a body of a user and having at least two straps comprising: a pivoting strap connection arrangement connected to the at least two straps, the pivoting strap connection arrangement comprising a pivot axis extending in a direction substantially perpendicular to a longitudinal axis of the at least two straps, wherein the at least two straps are pivotally movable relative to one another about the pivot axis.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

DETAILED DESCRIPTION OF THE PREFERRED EMBODIMENTS

Figure 1:
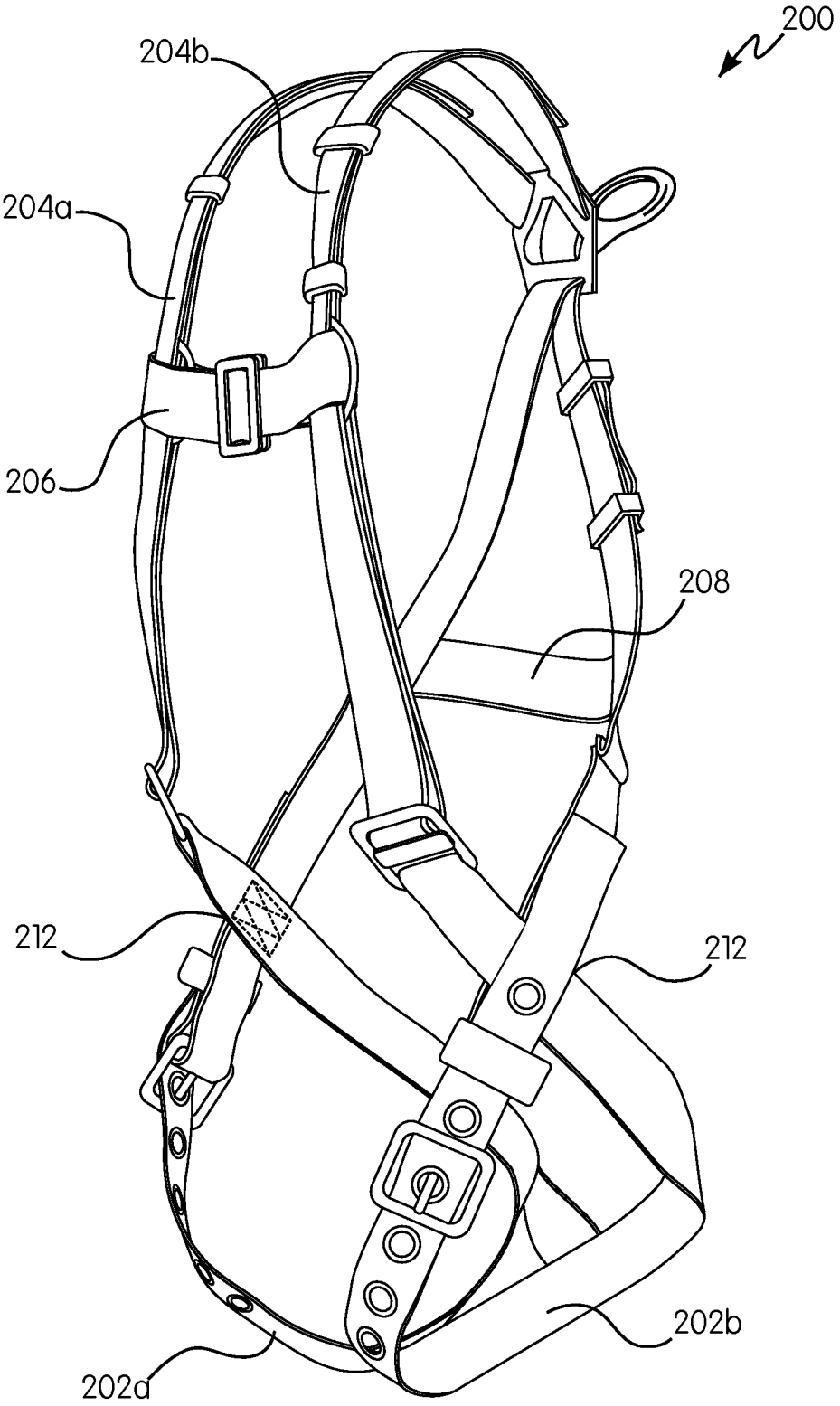
FIG. 1 (Prior Art)
FIG. 1 is a front perspective view of a harness in accordance with a prior art embodiment.
Figure 2A:
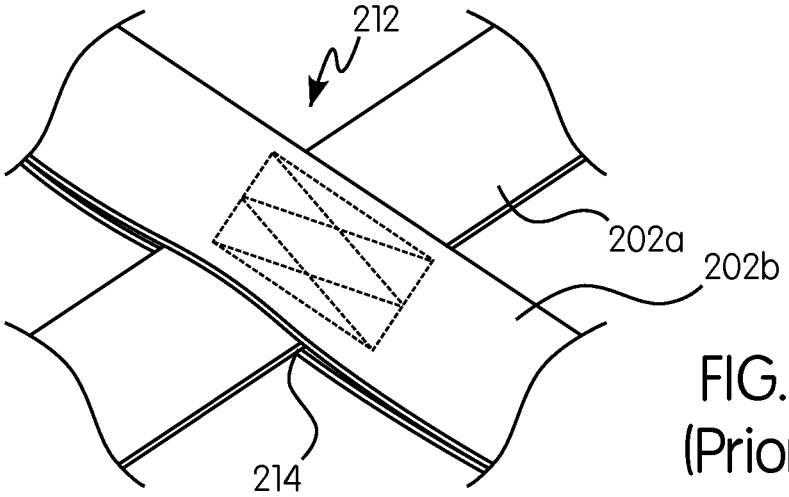
FIG. 2A (Prior Art
FIG. 2A is a detailed side view of a hip connection of a harness in accordance with a first prior art embodiment.
Figure 2B:
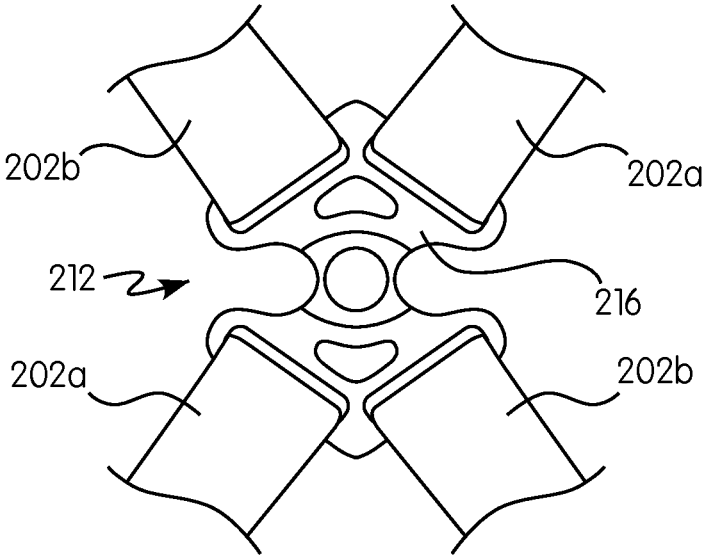
FIG. 2B (Prior Art
FIG. 2B is a detailed side view of a hip connection of a harness in accordance with a second prior art embodiment.
Figure 2C:
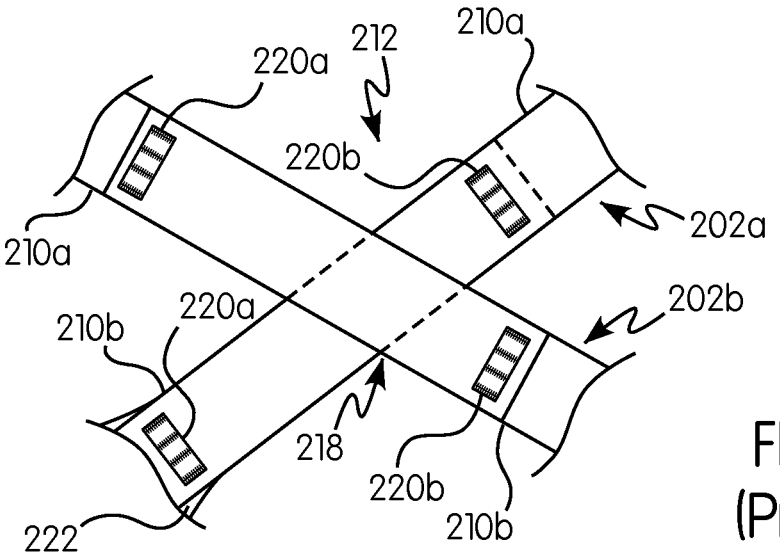
FIG. 2C (Prior Art
FIG. 2C is a detailed side view of a hip connection of a harness in accordance with a third prior art embodiment.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

As used in the specification and the claims, the singular form of "a", "an", and "the" include plural referents unless the context clearly dictates otherwise.

As used in the specification and the claims, the term "end" refers to the extreme distal portion or the area near or adjacent that portion.

Unless otherwise specified, the use of the term "attach", "attachable", and/or "attachment" includes a permanent, semi-permanent, removable, or adjustable attaching arrangement.

As used in the specification and the claims, the term "substantially parallel" means a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used in the specification and the claims, all ranges or ratios disclosed herein are to be understood to encompass any and all subranges or sub-ratios subsumed therein. For aspect or embodiment, a stated range or ratio of "1 to 10" should be considered to include any and all subranges between (and inclusive of) the minimum value of 1 and the maximum value of 10; that is, all sub-ranges or sub-ratios beginning with a minimum value of 1 or more and ending with a maximum value of 10 or less, such as but not limited to, 1 to 6.1, 3.5 to 7.8, and 5.5 to 10.

Figure 3:
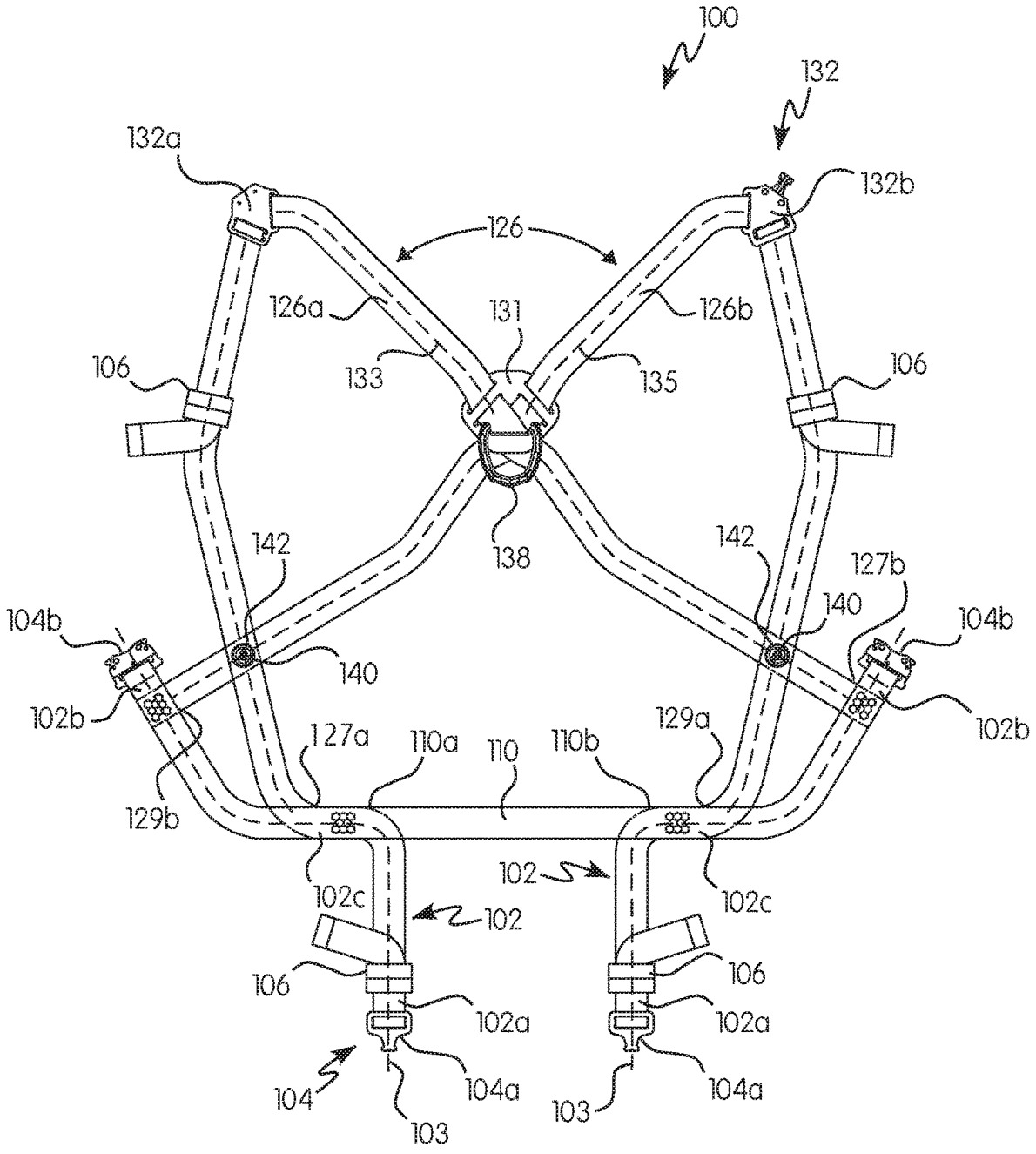
FIG. 3 is a front view of a harness in accordance with one preferred and non-limiting embodiment or aspect of the present disclosure.

In various preferred and non-limiting embodiments or aspects, and with reference to FIG. 3, the present disclosure is directed to a harness 100 used in a fall protection system. As discussed herein, the harness 100 has a pivoting strap connection arrangement configured for allowing a pivoting movement between at least two straps of the harness 100.

With continued reference to FIG. 3, the harness 100 has at least two leg straps 102 configured to attach around a user's legs below a user's groin area. When attached, the leg straps 102 loop around or encircle each of the user's legs. Each leg strap 102 has a first end 102*a* that is removably attachable to a second end 102*b*. The first end 102*a* is separated from the second end 102*b* along a longitudinal axis 103 extending in a direction along a major longitudinal length of each leg strap 102.

In some preferred and non-limiting embodiments or aspects, the first end 102*a* is removably attachable to the second end 102*b* via a connector 104. The connector 104 may be a clip, a buckle, a mating arrangement, an actuatable structure, or the like. The connector 104 permits removable attachment of the first end 102*a* to the second end 102*b* of each leg strap 102. In this manner, the first and second ends 102*a*, 102*b* of the leg straps 102 are configured to be removably attached to each other and configured to be free floating when detached from each other. In some preferred and non-limiting embodiments or aspects, at least one connector 104 and/or the leg strap 102 may have at least one adjustment mechanism 106 configured for adjusting the length of each leg strap 102. In this manner, the at least one connection mechanism 106 adjusts a distance between the first end 102*a* and the second end 102*b* such that each leg strap 102 may be adjusted to fit comfortably around the user's legs. Each leg strap 102 may be formed from a substantially flat webbing material typically used in harness construction.

In various preferred and non-limiting embodiments or aspects of the present disclosure, the leg straps 102 (or, indeed, any of the straps in the harness 100) may be linear lengths of material, folded straps that form loops with the at least one connector 104 at the first end 102*a* and/or the second end 102*b*, or the like. For example, as shown in FIG. 3, the connector 104 may have a first portion 104*a* that is non-adjustably attached to the first end 102*a* of at least one leg strap 102, while a second portion 104*b* of the connector 104 is adjustably secured at the second end 102*b* of at least one leg strap 102 through a loop of the material that makes up the leg strap 102. Therefore, in such an arrangement, the second portion 104*b* of the connector 104 and the loop of material that makes up the leg strap 102 at the second end 102*b* defines the at least one adjustment mechanism 106 for adjusting a length of the leg strap 102. It should be noted that the position of the adjustment mechanism 106 may be reversed such that the second portion 104*b* of the connector 104 is provided on the first end 102*a* of the leg strap 102. At least one leg strap 102 may have padding (not shown) for increasing the user's comfort while wearing the harness 100.

With continued reference to FIG. 3, each leg strap 102 is connected to a back strap 110 at a substantially intermediate portion 102*c* of the leg strap 102 between the first end 102*a* and the second end 102*b*. In some preferred and non-limiting embodiments or aspects, the substantially intermediate portion 102*c* of the leg strap 102 may be directly and non-movably connected to the back strap 110, such as being sewn directly to the back strap 110.

In other preferred and non-limiting embodiments or aspects, the substantially intermediate portion 102*c* of each leg strap 102 may be connected to the rear end of the back strap 110 by a connection strap (not shown) to allow the substantially intermediate portion 102*c* of the leg strap 102 to slidably move along a front portion of the leg strap 102. In further preferred and non-limiting embodiments or aspects, the substantially intermediate portion 102*c* of each leg strap 102 may be connected to the rear end of the back strap 110 by a pivoting strap connection arrangement, as described herein, to allow the substantially intermediate portion 102*c* of the leg strap 102 to pivotally move relative to the back strap 110. Accordingly, the position of the leg straps 102 may be adjusted relative to the back strap 110 to increase the user's comfort while wearing the harness 100.

The back strap 110 is configured to extend around at least a rear portion of the user's body. The back strap 110 has a first end 110*a* that is attached to the intermediate portion 102*c* of the first leg strap 102 and a second end 110*b* that is attached to the intermediate portion 102*c* of the second leg strap 102. The back strap 110 may have padding (not shown) for increasing the user's comfort while wearing the harness 100. The back strap 110 may be formed from a substantially flat webbing material typically used in harness construction.

With continued reference to FIG. 3, the harness 100 further has the shoulder strap 126 configured to extend over at least a portion of the user's shoulders. The shoulder strap 126 may have a first shoulder strap 126*a* and a second shoulder strap 126*b* arranged to overlap one another in an X-shaped configuration across the user's back. In some preferred and non-limiting embodiments or aspects, the shoulder strap 126 may have at least one shoulder pad 131 having one or more openings through which the first shoulder strap 126*a* and the second shoulder strap 126*b* can be arranged to maintain the first shoulder strap 126*a* and the second shoulder strap 126*b* in the X-shaped configuration. The first shoulder strap 126*a* has a first end 127*a* separated from a second end 127*b* along a longitudinal axis 133 extending in a direction along a major longitudinal length of the first shoulder strap 126*a*. Similarly, the second shoulder strap 126*b* has a first end 129*a* separated from a second end 129*b* along a longitudinal axis 135 extending in a direction along a major longitudinal length of the second shoulder strap 126*b*. The first and second shoulder straps 126*a*, 126*b* cross over each other at a hip connection 142. As described herein, the first and second shoulder straps 126*a*, 126*b* are pivotally movable relative to one another via a pivoting strap connection arrangement 140.

With continued reference to FIG. 3, the first end 127*a* of the first shoulder strap 126*a* is connected to the first end 110*a* of the back strap 110 and the intermediate portion 102*c* of the leg strap 102. The first end 127*a* of the first shoulder strap 126*a* may be removably or non-removably attachable to the first end 110*a* of the back strap 110 and the intermediate portion 102*c* of the leg strap 102. In some preferred and non-limiting embodiments or aspects, the first end 127*a* of the first shoulder strap 126*a* may be attached to the first end 110*a* of the back strap 110 and the intermediate portion 102*c* of the leg strap 102 via a connector similar to the connector 104 described herein with reference to the leg straps 102. In some preferred and non-limiting embodiments or aspects, the first end 127*a* of the first shoulder strap 126*a* may be connected to the first end 110*a* of the back strap 110 and the intermediate portion 102*c* of the leg strap 102 by way of a pivoting strap connection arrangement, as described herein, to allow for a pivoting movement of the first shoulder strap 126*a* relative to the back strap 110 and the leg strap 102.

The first shoulder strap 126*a* further has a second end 127*b* that is connected to the one of the two leg straps 102. In some preferred and non-limiting embodiments or aspects, the second end 127*b* of the first shoulder strap 126*a* is connected to the leg strap 102 proximate to the second end

102*b* of the leg strap 102, such as by being sewn directly to the leg strap 102. In some preferred and non-limiting embodiments or aspects, the second end 127*b* of the first shoulder strap 126*a* may be connected to the second end 102*b* of the leg strap 102 by way of a pivoting strap connection arrangement, as described herein, to allow for a pivoting movement of the first shoulder strap 126*a* relative to the leg strap 102. At least a portion of the first shoulder strap 126*a* may be formed from a substantially flat webbing material typically used in harness construction.

With continued reference to FIG. 3, the second shoulder strap 126*b* has a first end 129*a* that is connected to the second end 110*b* of the back strap 110 and the intermediate portion 102*c* of the leg strap 102. The first end 129*a* of the second shoulder strap 126*b* may be removably or non-removably attachable to the second end 110*b* of the back strap 110 and the intermediate portion 102*c* of the leg strap 102. In some preferred and non-limiting embodiments or aspects, the first end 129*a* of the second shoulder strap 126*b* may be attached to the second end 110*b* of the back strap 110 and the intermediate portion 102*c* of the leg strap 102 via a connector similar to the connector 104 described herein with reference to the leg straps 102. In some preferred and non-limiting embodiments or aspects, the first end 129*a* of the second shoulder strap 126*b* may be connected to the second end 110*b* of the back strap 110 and the intermediate portion 102*c* of the leg strap 102 by way of a pivoting strap connection arrangement, as described herein, to allow for a pivoting movement of the second shoulder strap 126*b* relative to the back strap 110 and the leg strap 102.

The second shoulder strap 126*b* further has a second end 129*b* that is connected to one of the two leg straps 102. In some preferred and non-limiting embodiments or aspects, the second end 129*b* of the second shoulder strap 126*b* is connected to the leg strap 102 proximate to the second end 102*b* of the leg strap 102, such as by being sewn directly to the leg strap 102. In some preferred and non-limiting embodiments or aspects, the second end 129*b* of the second shoulder strap 126*b* may be connected to the second end 102*b* of the leg strap 102 by way of a pivoting strap connection arrangement, as described herein, to allow for a pivoting movement of the second shoulder strap 126*b* relative to the leg strap 102. At least a portion of the second shoulder strap 126*b* may be formed from a substantially flat webbing material typically used in harness construction.

The harness 100 further may have a chest connector 132 having first portion 132*a* removably connectable to a second portion 132*b* in a region of the user's chest. The first portion 132*a* of the chest connector 132 may be positioned on the first shoulder strap 126*a* between the first end 127*a* and the second end 127*b*, while the second portion 132*b* of the chest connector 132 may be positioned on the second shoulder strap 126*b* between the first end 129*a* and the second end 129*b*. In some preferred and non-limiting embodiments or aspects, the chest connector 132 may be a clip, a buckle, a mating arrangement, an actuatable structure, or the like. In this manner, the first and second portions 132*a*, 132*b* of the chest connector 132 are configured to be removably attached to each other and configured to be free floating when detached from each other.

In some preferred and non-limiting embodiments or aspects, at least one of the first shoulder strap 126*a* and the second shoulder strap 126*b* may have at least one adjustment mechanism, such as the adjustment mechanism 106 described herein with reference to the leg straps 102. The adjustment mechanism 106 is configured for adjusting the length of the first and second shoulder straps 126*a*, 126*b* such that the first and second shoulder straps 126*a*, 126*b* can comfortably fit over the user's shoulders.

With further reference to FIG. 3, the shoulder strap 126 has an anchor element, such as a D-ring 138, for connecting at least a portion of the shoulder strap 126 to a line connected to an anchor point. In some preferred and non-limiting embodiments or aspects, at least a portion of the first shoulder strap 126*a* and the second shoulder strap 126*b* is looped around or otherwise permanently attached to the D-ring 138. The D-ring 138 has a frame defining at least one opening through which the first shoulder strap 126*a* and the second shoulder strap 126*b* may be looped around. In some preferred and non-limiting embodiments or aspects, the frame of the D-ring 138 has a first opening through which the first shoulder strap 126*a* and the second shoulder strap 126*b* extend, and a second opening which may be used to secure the clip, such as a carabiner, of a lanyard or other rope or line between the harness 100 and the anchor point (or secure other items to the harness 100).

Figure 4:
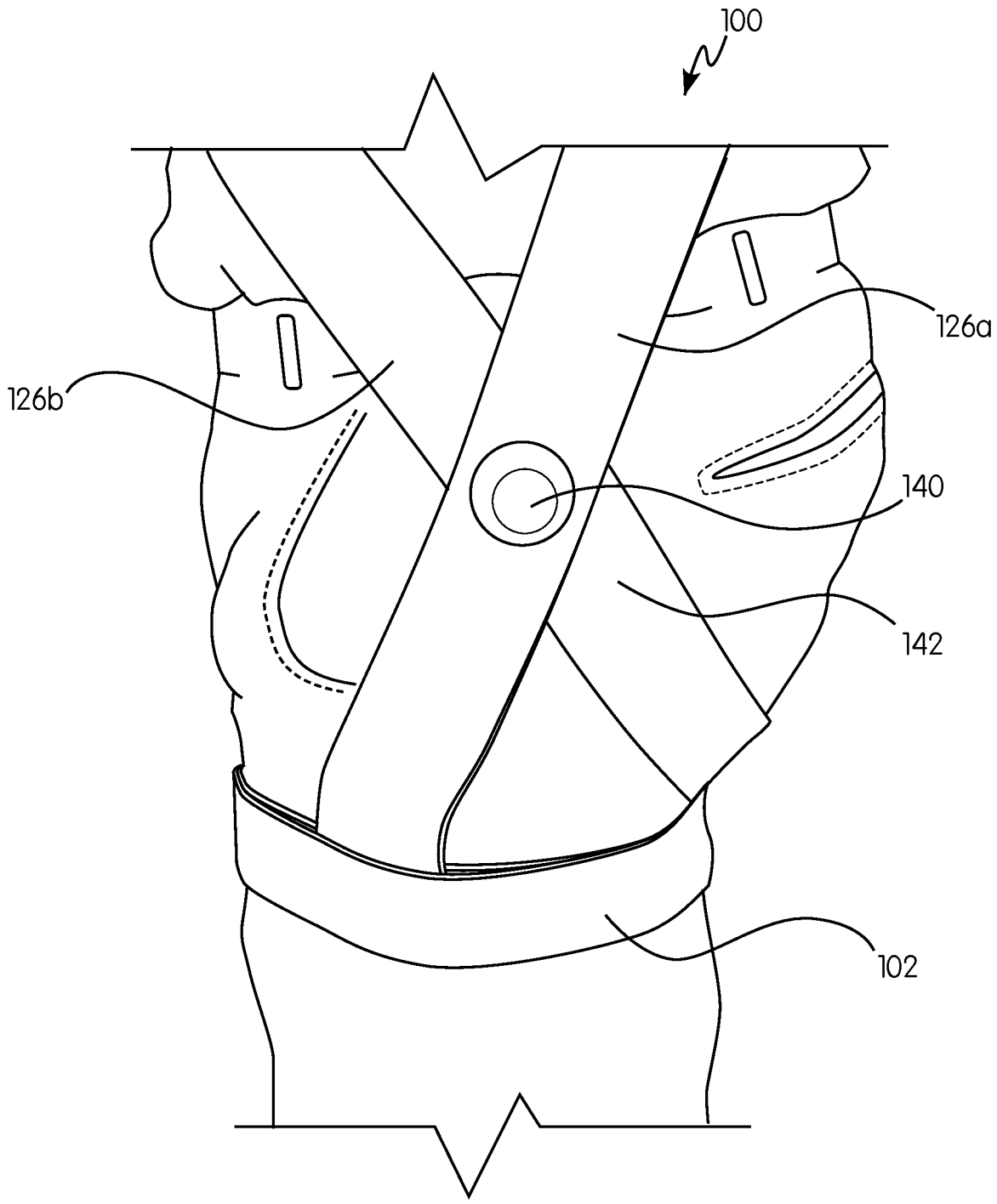
FIG. 4 is a detailed side view of a hip connection of the harness shown in FIG. 3.

Having described the general structure of the harness 100 in accordance with some preferred and non-limiting embodiments or aspects, the pivoting strap connection arrangement 140 will now be described with reference to FIGS. 4-7. In various embodiments or aspects, the pivoting strap connection arrangement 140 is positioned on at least two straps to allow for a pivoting movement of the straps relative to one another about a pivot point. While FIG. 4 shows the pivoting strap connection arrangement 140 provided at an intersection between the first shoulder strap 126*a* and the second shoulder strap 126*b* at the hip connection 142, the pivoting strap connection arrangement 140 may be provided at an intersection of any two or more straps of the harness 100. In some embodiments or aspects, the pivoting strap connection arrangement 140 may be provided at the connection between the first and/or second shoulder straps 126*a*, 126*b* and the respective leg straps 102. In some embodiments or aspects, the pivoting strap connection arrangement 140 may be provided at the connection between the first and/or second shoulder straps 126*a*, 126*b* and the belt strap 110. In some embodiments or aspects, the pivoting strap connection arrangement 140 may be provided at the connection between the first and second shoulder straps 126*a*, 126*b*. In some embodiments or aspects, the pivoting strap connection arrangement 140 may be provided at the connection between the first and/or second shoulder straps 126*a*, 126*b* and the respective leg straps 102. In some embodiments or aspects, the pivoting strap connection arrangement 140 may be provided at the connection between the leg straps 102 and the belt strap 110. One of ordinary skill in the art will appreciate that the following discussion of the pivoting strap connection arrangement 140 may be adapted for use on any connection between at least two straps of the harness 100 where a pivoting movement of the at least two straps is desired.

Figure 5A:
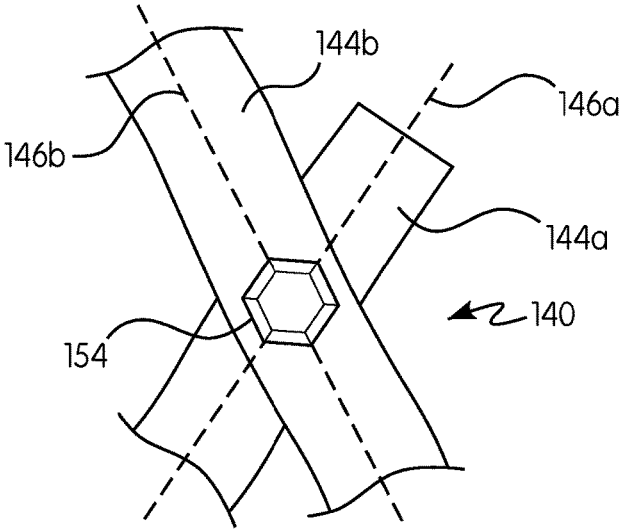
FIG. 5A is a side view of a pivoting strap connection arrangement in accordance with one preferred and non-limiting embodiment or aspect of the present disclosure.
Figure 5B:
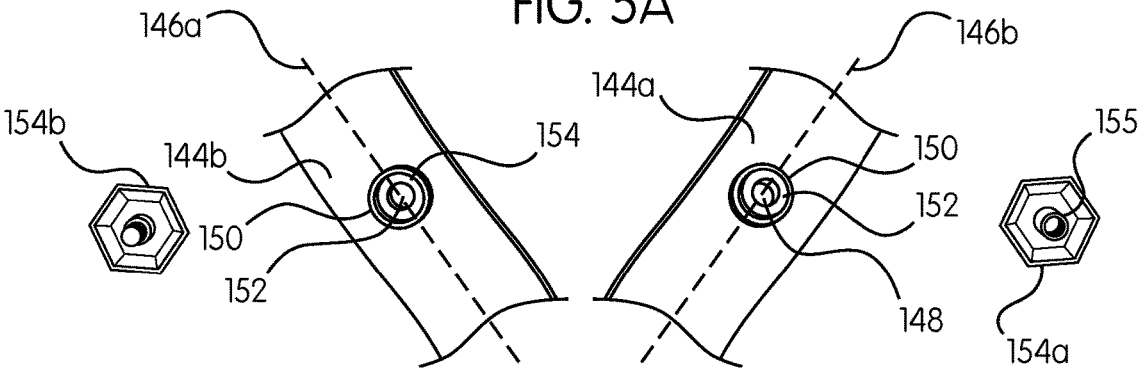
FIG. 5B is an exploded view of the pivoting strap connection arrangement shown in FIG. 5A.

With reference to FIGS. 5A-5B, the pivoting strap connection arrangement 140 according to a preferred and non-limiting embodiment or aspect is shown. The pivoting strap arrangement 140 is configured for use with at least two straps of the harness 100 (shown in FIG. 3), such as a first strap 144*a* and a second strap 144*b*. In some preferred and non-limiting embodiments or aspects, the pivoting strap connection arrangement 140 may be configured for use with more than two straps. In some preferred and non-limiting embodiments or aspects, the first strap 144*a* and the second strap 144*b* are chosen from at least a portion of the following: the first shoulder strap 126*a*, the second shoulder strap 126*b*, the back strap 110, the leg straps 102, the rear connection strap 130, the chest strap 132, and combinations thereof. In one preferred and non-limiting embodiment or aspect, the first strap 144*a* is at least a portion of the first shoulder strap 126*a* and the second strap 144*b* is at least a portion of the second shoulder strap 126*b* intersecting at a hip connection 142 (shown in FIG. 4).

With continued reference to FIGS. 5A-5B, each of the first strap 144*a* and the second strap 144*b* has a longitudinal axis 146*a*, 146*b*, respectively, extending in a direction along a major longitudinal length of the first strap 144*a* and the second strap 144*b*. The first and second straps 144*a*, 144*b* intersect each other in a direction along their longitudinal axes 146*a*, 146*b* and are pivotally connected to each other to allow for a pivoting movement about a pivot axis 148 extending in a direction substantially perpendicular to the longitudinal axes 146*a*, 146*b*.

The pivoting strap connection arrangement has a grommet 150 attached to at least one of the first strap 144*a* and the second strap 144*b*. The grommet 150 extends through the material of the first strap 144*a* and the second strap 144*b* between lateral sides of the first strap 144*a* and the second strap 144*b*. The grommet 150 has a central opening 152 extending in a direction that is substantially perpendicular to the direction of the longitudinal axes 146*a*, 146*b* of the first and second straps 144*a*, 144*b*. The central opening 152 on each of the first strap 144*a* and the second strap 144*b* defines the pivot axis 148 about which the first and second straps 144*a*, 144*b* are pivotally movable relative to each other when their pivot axes 148 are coaxially aligned. In some embodiments or aspects, at least one of the grommets 150 is non-removably attached to the respective first and second straps 144*a*, 144*b*. In some embodiments or aspects, at least one of the grommets 150 is removably attached to the respective first and second straps 144*a*, 144*b*. The grommets 150 may be identical or different from one another. The grommets 150 may be made from metal, plastic, or a combination thereof.

In some preferred and non-limiting embodiments or aspects, at least one of the first strap 144*a* and the second strap 144*b* may have an opening, similar to the central opening 152, that is cut, punched through, or otherwise formed through the material of at least one of the first strap 144*a* and the second strap 144*b*. The edges of the opening may be reinforced, such as by a threaded border or by melting the strap material around the opening, to prevent the strap material from fraying at the opening. As used herein, the central opening 152 of the grommet 150 and the opening that is cut, punched through or otherwise formed through the material of at least one of the first strap 144*a* and the second strap 144*b* is also referred to herein as a reinforced opening.

In some preferred and non-limiting embodiments or aspects, a single grommet 150 (shown in FIG. 7) may be provided for the first strap 144*a* and the second strap 144*b*. The first strap 144*a* and the second strap 144*b* are connected to one another with the single grommet 150 such that the straps 144*a*, 144*b* are pivotally movable about a pivot axis 160 extending through a center of the central opening 152 of the grommet 150. One or more spacers (not shown) may be provided between the first strap 144*a* and the second strap 144*b* (and/or any additional straps) to allow for a pivoting movement of the straps about the pivot axis 148.

With reference to FIGS. 5A-5B, the pivoting strap connection arrangement 140 further has a connecting element 154 configured for being received within the central opening 152 of the grommet 150 or through the reinforced opening that is cut, punched through, or otherwise formed through the material of at least one of the first strap 144*a* and the second strap 144*b*. The connecting element 154 has a longitudinal axis 155 that is coaxial with the pivot axis 148 when the connecting element 154 is inserted into the central opening 152 of the grommet 150 or through the reinforced opening that is cut, punched through, or otherwise formed through the material of at least one of the first strap 144*a* and the second strap 144*b*. When inserted into the central opening 152 of the grommets 150 or the reinforced opening of at least one of the first strap 144*a* and the second strap 144*b*, the connecting element 154 connects the first strap 144*a* to the second strap 144*b* and allows relative movement therebetween in a direction about the pivot axis 148. The longitudinal axis 155 of the connecting element 154 is coaxial with the pivot axis 148 of the grommet 150 when the connecting element 154 is inserted through the central opening 152 of the grommet 150 or the reinforced opening of at least one of the first strap 144*a* and the second strap 144*b*. In some embodiments or aspects, the first strap 144*a* may be pivotable relative to the second strap 144*b* over a range of 0 to 180° about the pivot axis 148.

In some preferred and non-limiting embodiments or aspects, the connecting element 154 is a load bearing element of the harness 100 (shown in FIG. 3), meaning that the connecting element 154 is designed not to break (i.e., remain intact) during a fall event. In other preferred and non-limiting embodiments or aspects, the connecting element 154 is not a load-bearing element of the harness 100 and is designed to break during a fall event.

In other preferred and non-limiting embodiments or aspects, the connecting element 154 is configured as a load indicator, wherein the connecting element 154 is configured to break after being exposed to a predetermined force. The predetermined force may be a shear force in a direction substantially perpendicular to the pivot axis 148, an axial force in a direction parallel with the pivot axis 148, or a combination thereof. The predetermined force may be in a range of about 75 lbs. to about 2250 lbs. In situations where the connecting element 154 is exposed to a force that is below the predetermined force, the connecting element 154 is configured to remain intact. When the connecting element 154 is exposed to a force that is greater than the predetermined force, the connecting element 154 is configured to break. The connecting element 154 may have a weakened portion 159 (shown in FIG. 6) configured to initiate the breaking of the connecting element 154 after being exposed to a force above the predetermined force. Breaking of the connecting element 154 indicates that the pivoting strap connection arrangement 140, and thereby the harness 100, experienced a force above a predetermined threshold. The portion of the harness 100 that breaks after being exposed to a predetermined force, such as the pivoting strap connection arrangement 140, may be repaired by replacing the connecting element 154. Alternatively, the harness 100 may be discarded.

With continued reference to FIG. 5B, the connecting element 154 has a first portion 154*a* that is removably connected to a second portion 154*b*. In some embodiments or aspects, the first portion 154*a* and the second portion 154*b* may be threadably connected to one another, wherein the first portion 154*a* is configured as a bolt having a male thread and the second portion 154*b* is configured as a nut having a female thread configured for threadably receiving the male thread. In other embodiments or aspects, the first portion 154*a* and the second portion 154*b* may be secured to one another by an interference fit (wherein the first portion 154*a* and the second portion 154*b* are removably or non-removably connected together by a frictional engagement due to dimensional differences therebetween), a snap fit (wherein one of the first portion 154*a* and the second portion 154*b* has one or more grooves and the other of the first portion 154*a* and the second portion 154*b* has one or more projections configured to receive the one or more grooves), an adhesive (wherein the adhesive is disposed between the first portion 154*a* and the second portion 154*b*), a welded connection (such as by spin, sonic, or other type of welding between the first portion 154*a* and the second portion 154*b*), or any other mechanical connection arrangement. In some embodiments or aspects, the first portion 154*a* and the second portion 154*b* may be non-removably connected to one another. In such embodiments or aspects, the connecting element 154 may be a rivet that defines a riveted connection.

Figure 6:
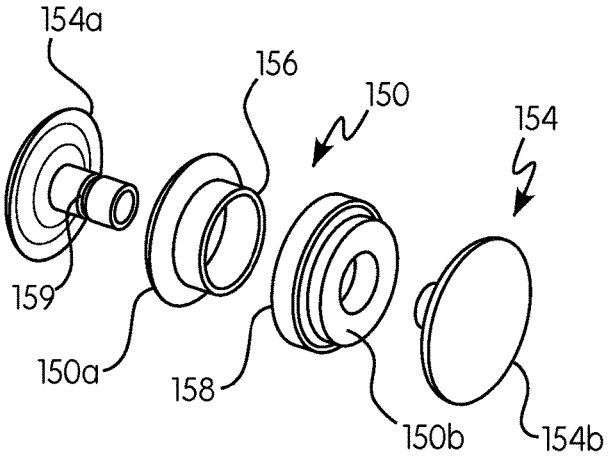
FIG. 6 is a side view of a pivoting strap connection arrangement in accordance with another preferred and non-limiting embodiment or aspect of the present disclosure.
Figure 7:
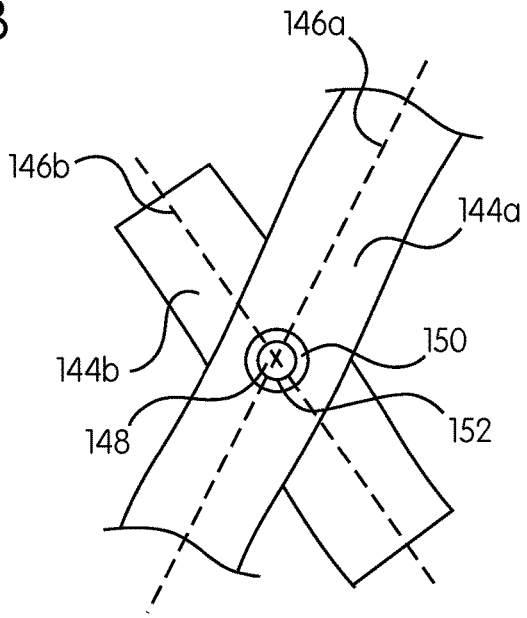
FIG. 7 is a side view of a pivoting strap connection arrangement in accordance with another preferred and non-limiting embodiment or aspect of the present disclosure.

With reference to FIG. 6, the pivoting strap connection arrangement 140 according to a preferred and non-limiting embodiment or aspect is shown. The components of the pivoting strap connection arrangement 140 shown in FIG. 6 are substantially similar to the components of the pivoting strap connection arrangement 140 described herein with reference to FIGS. 5A-5B. As the previous discussion regarding the pivoting strap connection arrangement 140 generally shown in FIGS. 5A-5B is applicable to the embodiment or aspect of the present disclosure shown in FIG. 6, only the relative differences between the pivoting strap connection arrangement 140 generally shown in FIG. 6 and the pivoting strap connection arrangement 140 shown in FIGS. 5A-5B are discussed hereinafter.

The pivoting strap connection arrangement 140 shown in FIG. 6 has a first grommet 150*a* configured for connecting to the first strap 144*a* (shown in FIGS. 5A-5B) and a second grommet 150*b* configured for connecting to the second strap 144*b* (shown in FIGS. 5A-5B). The first and second grommets 150*a*, 150*b* are configured to be removably or non-removably connected to each other. In some embodiments or aspects, the first grommet 150*a* has a protrusion 156 that is received within a recess 158 of the second grommet 150*b*. In other embodiments or aspects, the protrusion 156 may be provided on the second grommet 150*b*, while the recess 158 is provided on the first grommet 150*a*. The protrusion 156 and the recess 158 are shaped to form a mechanical connection therebetween. In some embodiments or aspects, the mechanical connection may be a releasable mechanical connection, wherein the protrusion 156 is separable from the recess 158 to inspect the harness 100 (shown in FIG. 3). The connecting element 154 having a first portion 154*a* and a second portion 154*b* may be provided to prevent the first grommet 150*a* from separating from the second grommet 150*b*. In other embodiments or aspects, the mechanical connection may be a non-releasable mechanical connection, wherein the protrusion 156 is not separable from the recess 158 after the two components are connected.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A wearable harness comprising:

a first strap overlapping a second strap, each of the first strap and the second strap having a longitudinal axis extending in a direction of a longitudinal length, a first end non-removably and directly connected to a first connecting strap, and a second end non-removably and directly connected to a second connecting strap;

a reinforced opening extending through each of the first strap and the second strap between the respective first and second ends of the first strap and the second strap, and a connecting element received within each reinforced opening, wherein the reinforced openings have a pivot axis extending in a direction substantially perpendicular to the longitudinal axis of the first strap and the second strap when the reinforced openings overlap each other, wherein the first strap and the second strap are pivotally movable relative to one another about the pivot axis, wherein the connecting element is configured to break when exposed to a predetermined force, and wherein the connecting element has a weakened portion provided therein and wherein the weakened portion is configured to initiate a breaking of the connecting element when the connecting element is exposed to the predetermined force.

2. The wearable harness of claim 1, wherein the first strap is at least a portion of a first shoulder strap and the second strap is at least a portion of a second shoulder strap.

3. The wearable harness of claim 1, wherein at least one of the reinforced openings is a central opening of a grommet comprising a first grommet on the first strap and a second grommet on the second strap.

4. The wearable harness of claim 3, wherein the first grommet is identical to the second grommet.

5. The wearable harness of claim 3, wherein one of the first grommet and the second grommet has a protrusion and the other of the first grommet and the second grommet has a recess configured for removably or non-removably receiving the protrusion.

6. The wearable harness of claim 3, wherein the connecting element is received within the central opening extending through each of the first grommet and the second grommet.

7. The wearable harness of claim 1, wherein at least one of the reinforced openings is a central opening of a grommet extending in a direction substantially perpendicular to the longitudinal axis of the first strap and the second strap.

8. The wearable harness of claim 1, wherein the connecting element comprises a first portion removably connected to a second portion, and wherein the weakened portion is provided between the first portion and the second portion.

9. The wearable harness of claim 8, wherein the first portion and the second portion of the connecting element are connected to one another by a threaded connection, an interference fit, snap fit, an adhesive, a spin welded connection, a sonic welded connection, a riveted connection, or a combination thereof.

10. The wearable harness of claim 1, wherein the predetermined force is a shear force directed in a direction substantially perpendicular to a longitudinal axis of the connecting element.

11. The wearable harness of claim 1, wherein the predetermined force is about 75 lbs. to about 2250 lbs.

12. A wearable harness comprising:

at least two overlapping straps, each of the at least two overlapping straps having a longitudinal axis extending in a direction of a longitudinal length, a first end non-removably and directly connected to a first connecting strap, and a second end non-removably and directly connected to a second connecting strap; and a pivoting strap connection arrangement connected to the at least two overlapping straps, the pivoting strap connection arrangement comprising:

a reinforced opening extending through each of the at least two overlapping straps between the respective first and second ends of the overlapping straps, the reinforced openings having a pivot axis extending in a direction substantially perpendicular to the longitudinal axis of each of the at least two overlapping straps when the reinforced openings overlap each other, and a connecting element received within each reinforced opening, wherein the at least two overlapping straps are pivotally movable relative to one another about the pivot axis, wherein the connecting element is configured to break when exposed to a predetermined shear force directed in a direction substantially perpendicular to a longitudinal axis of the connecting element, and wherein the connecting element has a weakened portion provided therein and wherein the weakened portion is configured to initiate a breaking of the connecting element when the connecting element is exposed to the predetermined force.

13. The wearable harness of claim 12, wherein at least one of the reinforced openings is a central opening of a grommet having a first grommet on a first of the at least two overlapping straps and a second grommet on a second of the at least two overlapping straps.

14. The wearable harness of claim 13, wherein one of the first grommet and the second grommet has a protrusion and the other of the first grommet and the second grommet has a recess configured for removably or non-removably receiving the protrusion.

15. The wearable harness of claim 12, wherein the connecting element comprises a first portion removably connected to a second portion.

* * * * *